US006915858B2

(12) United States Patent
Dolyniuk et al.

(10) Patent No.: US 6,915,858 B2
(45) Date of Patent: Jul. 12, 2005

(54) ELEMENT LATCH SYSTEM AND METHOD OF USE

(75) Inventors: David A. Dolyniuk, Tomball, TX (US); George S. Arnold, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 15 days.

(21) Appl. No.: 10/279,414

(22) Filed: Oct. 24, 2002

(65) Prior Publication Data

US 2003/0121670 A1 Jul. 3, 2003

Related U.S. Application Data

(60) Provisional application No. 60/339,030, filed on Oct. 30, 2001.

(51) Int. Cl.[7] ..... E21B 33/127

(52) U.S. Cl. ..... 166/387; 166/187; 166/182

(58) Field of Search ..... 166/387, 187, 166/182, 123, 305.1, 373, 386, 181, 192, 134

(56) References Cited

U.S. PATENT DOCUMENTS

| | | | | |
|---|---|---|---|---|
| 2,605,845 A | | 8/1952 | Broyles | |
| 3,578,078 A | | 5/1971 | Shillander | |
| 3,670,815 A | | 6/1972 | Brown | |
| 3,941,190 A | * | 3/1976 | Conover | 166/187 |
| 4,345,653 A | * | 8/1982 | Baker et al. | 166/187 |
| 4,610,300 A | | 9/1986 | Mullins, II et al. | |
| 4,913,231 A | * | 4/1990 | Muller et al. | 166/250.17 |
| 5,143,015 A | * | 9/1992 | Lubitz et al. | 166/187 |
| 5,271,461 A | | 12/1993 | Decker et al. | |
| 5,749,419 A | * | 5/1998 | Coronado et al. | 166/387 |
| 5,954,137 A | * | 9/1999 | Coronado et al. | 166/387 |
| 6,691,788 B1 | * | 2/2004 | Dearing | 166/134 |

FOREIGN PATENT DOCUMENTS

| | | |
|---|---|---|
| GB | 2354273 A | 3/2001 |

* cited by examiner

*Primary Examiner*—David Bagnell
*Assistant Examiner*—Matthew J. Smith
(74) *Attorney, Agent, or Firm*—Steve Rosenblatt

(57) ABSTRACT

A latching assembly for a lower collar on an inflatable is provided. After deflation, the lower collar is engaged to the mandrel so that the deflated inflatable can be advanced with other connected downhole equipment, such as screens to be expanded, in a location further downhole without swabbing.

17 Claims, 2 Drawing Sheets

ELEMENT LATCH SYSTEM AND METHOD OF USE

PRIORITY INFORMATION

This application claims the benefit of U.S. Provisional Application No. 60/339,030 on Oct. 30, 2001.

FIELD OF THE INVENTION

The field of this invention is inflatable packers and more particularly those that can be deflated and subsequently advanced downhole without swabbing.

BACKGROUND OF THE INVENTION

Saving trips in a completion procedure saves money. Recently, screens have been run into open hole and expanded as a technique to replace the need to gravel pack. In these situations it is desirable to isolate the formation pressure from the upper part of the well as the screens are run in. The problem in the past has been that once the inflatable is deflated, trying to advance it further into the wellbore to total depth can cause a condition known as swabbing. In an inflatable, the element has a lower movable collar, which rides uphole as the element is inflated. When the element is deflated the lower collar is free to move on the mandrel. Thus if the screen, which had before deflation been tagged into the inflatable, is advanced with the deflated inflatable, the lower collar will ride up when any portion of the element engages the borehole wall. The element will then ball up in a phenomenon known as swabbing.

The present invention addresses this problem by using the downhole force to advance the deflated inflatable with the screen to also keep the deflated element in a stretched condition to avoid swabbing. Those skilled in the art will appreciate the scope of the invention from the illustrative example of the preferred embodiment, which appears below and more particularly for the appended claims based thereon.

SUMMARY OF THE INVENTION

A latching assembly for a lower collar on an inflatable is provided. After deflation, the lower collar is engaged to the mandrel so that the deflated inflatable can be advanced with other connected downhole equipment, such as screens to be expanded, in a location further downhole without swabbing.

DETAILED DESCRIPTION OF THE DRAWINGS

FIG. 1 is a schematic view, showing the inflatable being run in;

DETAILED DESCRIPTION OF THE PREFERRED EMBODIMENT

Figure 5:
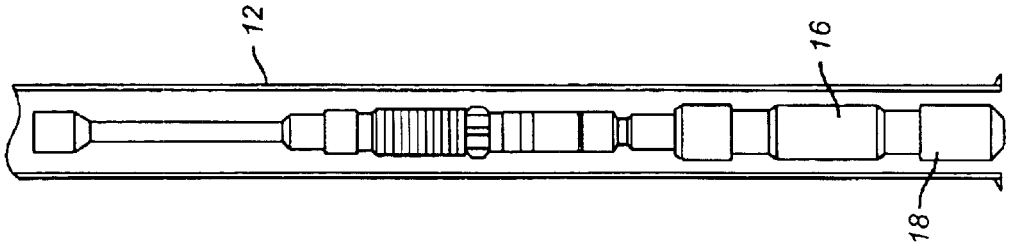
FIG. 5 shows the assembly of the de3flated inflatable and the screen advanced downhole, where the screen is to be deployed.
Figure 4:
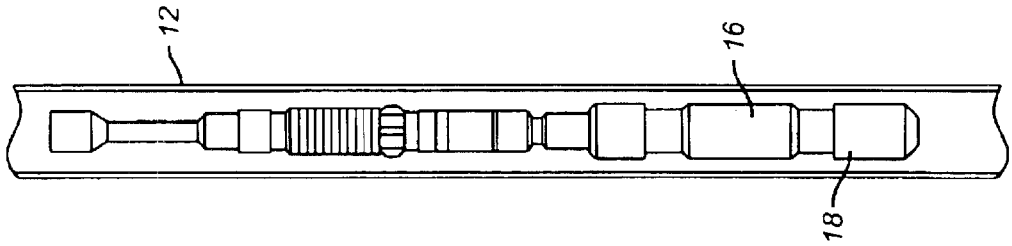
FIG. 4 shows the inflatable being deflated.
Figure 3:
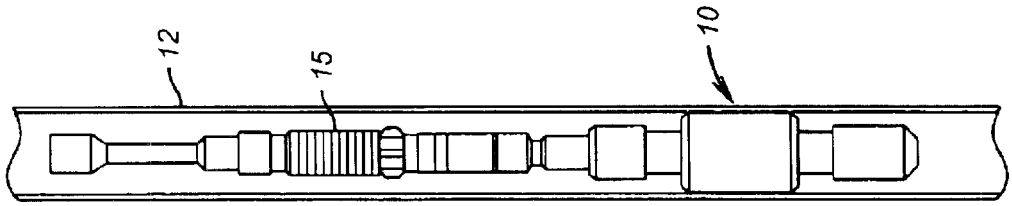
FIG. 3 shows a screen assembly being tagged into the set inflatable.
Figure 2:
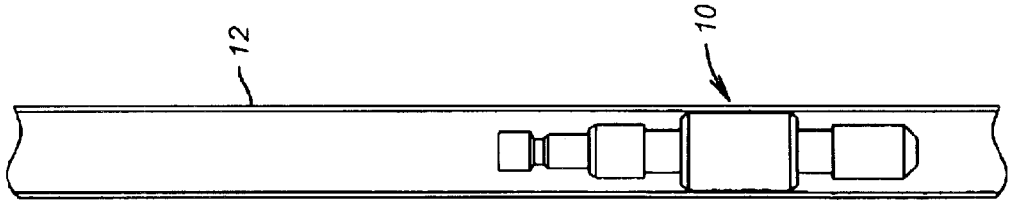
FIG. 2 shows the inflatable being set.
Figure 1:
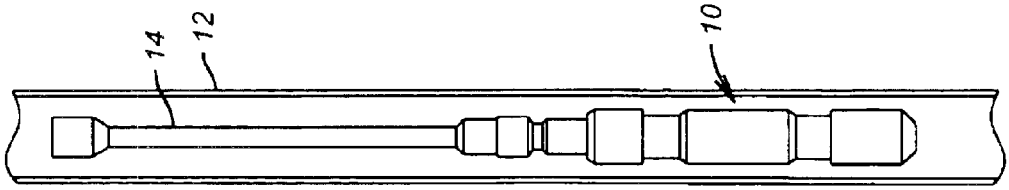
Figure 8:
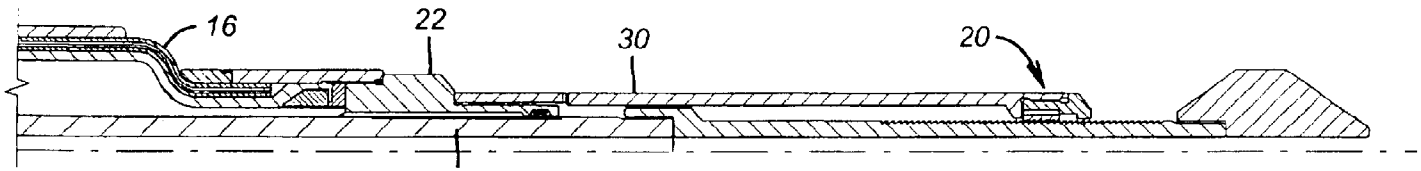
FIG. 8 is the view of FIG. 7 with the inflatable deflated and latched
Figure 9:
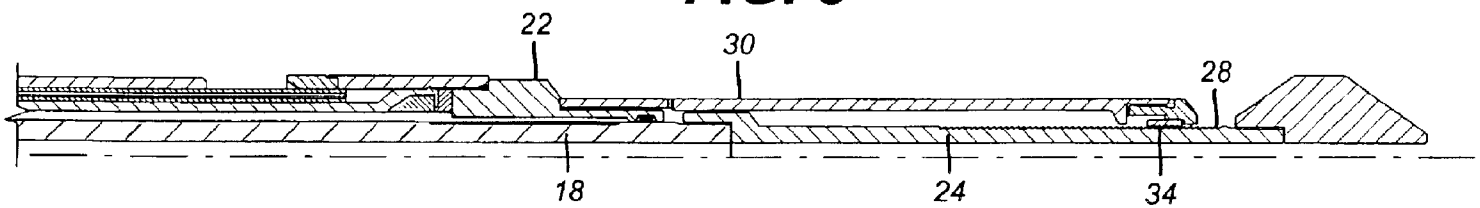
FIG. 9 is the view of FIG. 8 with the deflated element stretched out from being advanced downhole.

The overview of the present invention is shown in FIGS. 1–5. The inflatable 10 is run in the wellbore 12 on drill pipe, coiled tubing or electric wireline 14. It is set, as shown in FIG. 2, effectively isolating the top of the wellbore 12 from the formation below the now set inflatable 10. At this time, other downhole equipment can be run into the wellbore 12 without the use of a lubricator at the surface. In FIG. 3, a screen assembly 15 is tagged into the inflated inflatable 10. At the conclusion of the tagging procedure, the inflatable is deflated by mandrel manipulation, in a known manner. As will be later explained, the deflation of the inflatable 10 secures its inflatable element 16 to the mandrel 18 via a latch system 20 (see FIG. 8). Thereafter, as shown in FIGS. 5 and 9, the element 16 is stretched to its run in position, as the mandrel 18 is advanced downhole with the screen assembly 15. Those skilled in the art will appreciate that other equipment can be tagged into the inflatable 10 than screen assembly 15. The inflatable 10 can be run downhole and inflated in a variety of ways. The new feature of the latch system 20 can be executed in a variety of ways to allow a stretching force to be transmitted to the element 16 after it is deflated. This stretching force prevents the element 16 from swabbing, as it is advanced downhole after being inflated and deflated.

Figure 6:
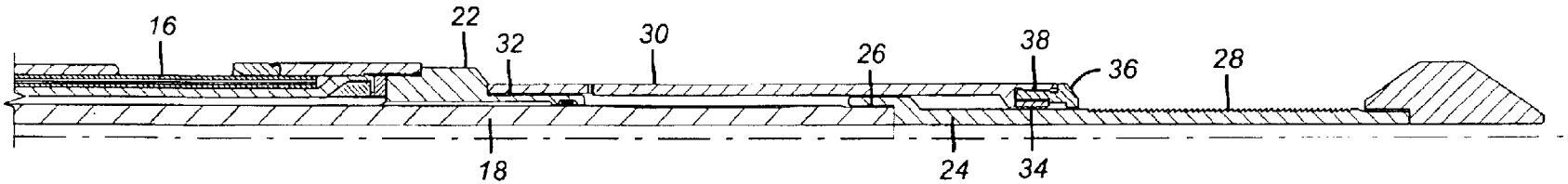
FIG. 6 is a half section view of the inflatable and the latch system in the run in position.
Figure 7:
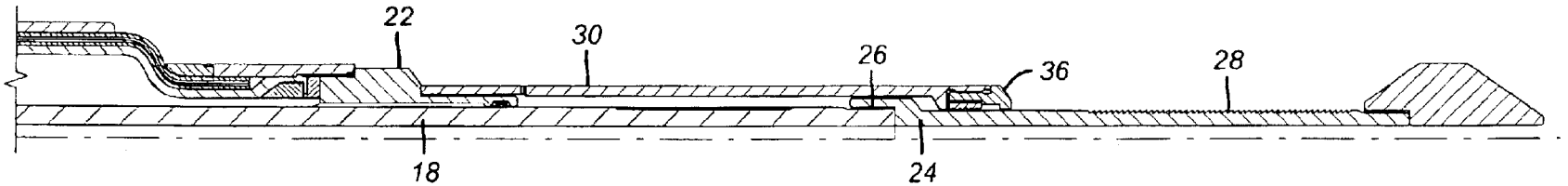
FIG. 7 is the view of FIG. 6 with the inflatable set.

In the preferred embodiment, the latching system is in the form of a ratchet. As shown in FIG. 6, in the run in position, the inflatable 10 has its element 16 in the stretched position to facilitate insertion. Typically the element 16 has a slidably mounted lower collar 22, which rides up when the element 16 is inflated, as shown in FIG. 7. In the present invention, the mandrel 18 has an extension 24 secured at thread 26. Extension 24 has ratchet teeth 28. Collar 22 has a sleeve 30 attached at thread 32. Sleeve 30 supports teeth 34, which selectively engage teeth 28, as will be explained below. Teeth 34 are retained by end cap 36, which is secured to sleeve 30 at thread 38.

As the element 16 is inflated, the collar 22 and sleeve 30 both ride up. This movement, shown in FIG. 7, tends to bring teeth 34 further away from teeth 28. It should be noted that during run in and set, there has been no engagement of the teeth 34 and 28.

When the screen assembly 15 has been tagged into the inflatable 10 (see FIG. 3), the inflatable is deflated in a known manner by setting down weight and then picking up. As shown in FIG. 8, when the pickup force is applied the teeth 28 ratchet past teeth 34. Subsequent downhole movement of the mandrel 18 with the extension 24 pulls teeth 34 down, since opposed relative movement is precluded by the orientation of teeth 28 and 34. As shown in FIG. 9, the downward force on the mandrel 18 and extension 24, pulls the deflated element 16 toward its retracted or run in position. The occurs because the lower collar 22 is forcibly pulled down by the latch system 20 while the upper collar (not shown) on the element 16 remains in position with respect to the advancing mandrel 18 carrying with it the lower collar 22.

Those skilled in the art will appreciate that the element 16 will not swab if it is stretched out using the latch system 20 of the present invention. The screen assembly 15 can then be run further downhole and expanded into place against the open hole. Those skilled in the art will appreciate that the present invention encompasses all techniques to grab the element and stretch it out after deflation. The ratchet teeth engagement depicted in the Figures is but one embodiment that is preferred. The full scope of the invention is delineated in the claims, which appear below. Modifications from the embodiment described above are clearly contemplated to be within the scope of the invention particularly if the result is an extension of the element after deflation so that upon further advancement into the wellbore, it will be prevented from swabbing. Apart from ratchets, the stretching of the element can be accomplished with a pressure responsive piston, a J-slot mechanism, or engaging a thread, to mention a few variations.

While the preferred embodiment has been described above, those skilled in the art will appreciate that other mechanisms are contemplated to accomplish the task of this invention, whose scope is delimited by the claims appended below, properly interpreted for their literal and equivalent scope.

The foregoing disclosure and description of the invention are illustrative and explanatory thereof, and various changes in the size, shape and materials, as well as in the details of the illustrated construction, may be made without departing from the spirit of the invention.

We claim:

1. An inflatable downhole tool, comprising:

a mandrel;

an inflatable element slidably mounted to said mandrel and movable responsive to inflation of said element;

said mandrel selectively engaging said element to extend said element when said mandrel is advanced downhole after said element is deflated.

2. An inflatable downhole tool, comprising:

a mandrel;

an inflatable element slidably mounted to said mandrel and movable responsive to inflation of said element;

said mandrel selectively engaging said element to extend said element when said mandrel is advanced downhole after said element is deflated;

at least one end of said element is slidable and said mandrel engages said element near said end.

3. The tool of claim 2, wherein:

said element comprises a collar mounted near said end, said collar selectively movable when not engaged to said mandrel and movable in tandem with said mandrel when engaged to said mandrel.

4. The tool of claim 3, wherein:

said collar engages said mandrel only after mandrel movement designed to deflate said element has been initiated.

5. The tool of claim 4, wherein:

said mandrel is moved with said element inflated to initiate deflation of said element and bring said collar in contact with said mandrel.

6. The tool of claim 4, wherein:

said collar and said mandrel comprise ratchet teeth that engage upon deflation of said element.

7. The tool of claim 6, wherein:

said teeth permit relative movement between said mandrel and said collar in one direction and prevent relative movement in the opposite direction.

8. The tool of claim 7, wherein:

said ratchet teeth can disengage, after initial engagement, upon sufficient relative movement.

9. A method for inserting tools into a wellbore above an inflatable packer, comprising:

running the packer;

inflating the packer;

releasing from the set inflatable packer;

running a tool into the wellbore to connect to said packer when said packer is inflated;

deflating the packer;

engaging a deflated element of said packer to a mandrel; and extending said deflated element when said mandrel is advanced downhole.

10. A method for inserting tools into a wellbore above an inflatable packer, comprising:

running in the packer;

inflating the packer;

releasing from the set inflatable packer;

running a tool into the wellbore to connect to said packer when said packer is inflated;

deflating the packer;

engaging a deflated element of said packer to a mandrel; and extending said deflated element toward said mandrel when said mandrel is advanced downhole;

selectively locking said element to said mandrel when said element is deflated.

11. A method for inserting tools into a wellbore above an inflatable packer, comprising:

running in the packer;

inflating the packer, releasing from the set inflatable packer;

running a tool into the wellbore to connect to said packer when said packer is inflated;

deflating the packer;

engaging a deflated element of said packer to a mandrel; and extending said deflated element toward said mandrel when said mandrel is advanced downhole;

selectively locking said element to said mandrel when said element is deflated;

providing a movable collar adjacent an end of said element; and providing a ratchet on said collar to selectively engage a ratchet on said mandrel.

12. The method of claim 11, wherein:

engaging said ratchets;

allowing relative movement between said mandrel and said collar in a first direction with said ratchets engaged.

13. The method of claim 12, comprising:

prohibiting relative movement between said mandrel and said collar in a second direction opposite said first direction.

14. The method of claim 13, comprising:

engaging said ratchets when deflating said element.

15. The method of claim 14, comprising:

creating relative movement in said first direction when deflating said element.

16. A method for inserting tools into a wellbore above an inflatable packer, comprising:

running in the packer;

inflating the packer;

releasing from the set inflatable packer;

running a tool into the wellbore to connect to said packer when said packer is inflated;

deflating the packer;

engaging a deflated element of said packer to a mandrel; and extending said deflated element toward said mandrel when said mandrel is advanced downhole;

using a screen as said tool.

17. A method for inserting tools into a wellbore above an inflatable packer, comprising:

running in the packer;

inflating the packer;

releasing from the set inflatable packer;

running a tool into the wellbore to connect to said packer when said packer is inflated;

deflating the packer;

engaging a deflated element of said packer to a mandrel; and extending said deflated element toward said mandrel when said mandrel is advanced downhole;

extending said element back toward its run in position after deflation.

* * * * *